United States Patent [19]

Christophorou et al.

[11] Patent Number: 4,937,500

[45] Date of Patent: Jun. 26, 1990

[54] BINARY AND TERNARY GAS MIXTURES WITH TEMPERATURE ENHANCED DIFFUSE GLOW DISCHARGE CHARACTERISTICS FOR USE IN CLOSING SWITCHES

[75] Inventors: Loucas G. Christophorou; Scott R. Hunter, both of Oak Ridge, Tenn.

[73] Assignee: The United States of America as represented by the United States Department of Energy, Washington, D.C.

[21] Appl. No.: 212,546

[22] Filed: Jun. 28, 1988

[51] Int. Cl.[5] ..... H01J 17/20; H05B 37/02; H05B 41/14

[52] U.S. Cl. ..... 315/150; 315/241 R; 313/637

[58] Field of Search ..... 313/637, 689, 643; 315/150, 358, 240, 241 R; 372/86

[56] References Cited

U.S. PATENT DOCUMENTS

| | | | |
|---|---|---|---|
| 2,504,498 | 5/1948 | Clock et al. | 315/240 |
| 2,977,508 | 7/1956 | Germeshausen | 315/241 R |
| 3,243,654 | 3/1966 | Wright | 315/241 R |
| 3,560,795 | 2/1971 | Pollack et al. | 315/240 |
| 4,490,650 | 12/1984 | Christophorou et al. | 315/150 |
| 4,751,428 | 6/1988 | Christophorou et al. | 313/637 |
| 4,792,724 | 12/1988 | Christophorou et al. | 313/637 |

*Primary Examiner*—Eugene R. LaRoche
*Assistant Examiner*—Ali Neyzari
*Attorney, Agent, or Firm*—Stephen D. Hamel; William R. Moser; Richard E. Constant

[57] ABSTRACT

An improvement to the gas mixture used in diffuse glow discharge closing switches is disclosed which includes binary and ternary gas mixtures which are formulated to exhibit decreasing electron attachment with increasing temperature. This increases the efficiency of the conductance of the glow discharge and further inhibits the formation of an arc.

10 Claims, 10 Drawing Sheets

BINARY AND TERNARY GAS MIXTURES WITH TEMPERATURE ENHANCED DIFFUSE GLOW DISCHARGE CHARACTERISTICS FOR USE IN CLOSING SWITCHES

The present invention was developed during work on a contract No. DE-AC05-840R21400 with the Department of Energy, and therefore, the Government has rights in this invention.

FIELD OF THE INVENTION

The present invention relates, in general, to the art of switches, and in particular, to the art of glow discharge switches. Specifically, the present invention relates to a gas mixture used in glow discharge closing switches used in capacitive energy storage circuits.

BACKGROUND OF THE INVENTION

In certain applications, such as high-power microwave sources, pulsed lasers, particle beam generators, nuclear event simulators, and directional energy weapons, and the like, it is necessary to store electrical energy for release in pulses having extremely fast rise times (e.g., $\leqq 10$ nanoseconds) and short durations (100 nanoseconds to microseconds).

High current self-sustained diffuse glow discharges are suitable for use in high voltage pulsed power applications where fast closing, high repetition rate switching is required. A schematic showing the operation of a UV light triggered glow discharge closing switch in a capacitive energy storage circuit is shown in FIG. 1. The major problems that have been encountered with this type of switch are the high impedance of the discharge and the instability of the glow discharge which leads to the formation of electrical arcs between the switch electrodes and consequently destroys the repetitive operation of the switch. The voltage waveform that appears across the switch electrodes is shown schematically in FIG. 2. The present disclosure describes gas mixtures which will lower the switch voltage $V_s$ (i.e., increase the switch efficiency) by the use of temperature modified electron attachment processes while at the same time increasing the stability of the discharge.

Accordingly, there is need for a gas mixture for use in such switches that has the capability for conducting a large amount of energy between the electrodes of a diffuse-discharge switch when the switch is in a conducting mode with a high electrical efficiency and which has a high insulating capability when the switch is in a nonconducting mode.

The physio-chemical properties required of the gas mixture to achieve high efficiency, stable discharge operation were discussed in detail for the first time in S. R. Hunter, L. G. Christophorou, J. G. Carter and P. G. Datskos, "New Concepts for High Current Self-Sustained Diffuse Discharge Closing Switches" to be published in the *Proceedings of the 6th IEEE Pulsed Power Conference,* Arlington, VA, June 29-July 1, 1987 (the disclosure of which is incorporated herein by reference). The stability of the glow discharge is enhanced by tailoring the electron attachment coefficient ($\eta/N$) and the ionization coefficient ($\alpha/N$) of the gas mixture in such a way that the rate of change in the electron production and loss is minimal during small perturbations of the applied electric field beyond the glow discharge operating voltage level $V_s$.

The invention disclosed in the co-pending application by the present inventors, the disclosure of which is fully incorporated herein by reference thereto (L. G. Christophorou and S. R. Hunter, "Ternary Gas Mixtures for Diffuse Discharge Switch," U.S. Pat. No. 4,751,428 issued June 14, 1988, discusses the various gases which may be used to improve the switching stability and efficiency of room temperature diffuse discharge closing switches. The present invention is distinguished from that invention by utilizing the heat generated in the diffuse discharge to improve the efficiency of the closing switch. This is accomplished by utilizing different physio-chemical properties of the gas mixture in comparison with those described in S. R. Hunter and L. G. Christophorou, "Binary and Ternary Gas Mixtures for Use in Glow Discharge Closing Switches," U.S. patent application, Ser. No. 186,856, filed Apr. 27, 1988 disclosure of which is fully incorporated herein by reference thereto, namely the large decrease in electron attachment with increasing gas temperature that has been observed to occur in several electronegative gases disclosed in the present disclosure.

However, increased efficiency and stability during the diffuse glow discharge is still needed to further enhance the desirable characteristics of this type of switch.

OBJECTS OF THE INVENTION

It is a main object of the present invention to provide an improved diffuse-discharge switch system for use in generating high-energy electrical pulses.

It is another object of the present invention to provide a diffuse-discharge switch having a gas mixture therein which conducts a large amount of electrical energy when initiated by an ultraviolet light source but which serves as an effective insulator when not activated by the light source.

It is another object of the present invention to provide a gas mixture for use in a glow discharg switch which exhibits temperature enhanced diffuse glow discharge characteristics.

It is another object of the present invention to provide a gas mixture for use in a glow discharge closing switch that will increase the efficiency of such a diffuse glow discharge closing switch at elevated temperatures.

It is another object of the present invention to provide a gas mixture for use in a glow discharge closing switch that will improve the stability at elevated temperatures of the switch during the conducting stage of that switch.

It is another object of the present invention to provide a gas mixture for use in a glow discharge closing switch which inhibit arc formation at elevated temperatures.

It is another object of the present invention to provide a gas mixture for use in a glow discharge closing switch which exhibits low resistivity at elevated temperatures during the conducting stage of operation.

It is another object of the present invention to provide a gas mixture for use in a glow discharge closing switch that exhibits fast recovery characteristics at elevated temperatures during the opening stage of operation.

It is another object of the present invention to provide binary and ternary gas mixtures for use in a glow discharge switch that exhibit temperature enhanced diffuse discharge characteristics.

SUMMARY OF THE INVENTION

These, and other, objects are accomplished by the present invention which is embodied in various gas mixtures that have temperature enhanced diffuse discharge characteristics that lead to stable low impedance glow discharges, thereby improving the switching characteristics of the system.

Specifically the gas mixtures embodying the present invention exhibit decreasing electron attachment at elevated temperatures thereby resulting in increased conductivity of the glow discharge. Such gas mixtures increase the efficiency of diffuse glow discharge switches above that of the gases used in previous glow discharge closing switches.

Most specifically, the present invention is embodied in a gas mixture exhibiting decreasing electron attachment with increasing gas temperature for use in diffuse glow discharge closing switches. The present invention comprises two species, as follows:

A gas selected from the group consisting of He, Ne, Ar, Kr, and Xe, or a mixture thereof, in combination with a second compound selected from the group consisting of c-$C_4F_8$, c-$C_4F_6$, n-$C_4F_{10}$, l-$C_3F_6$, c-$C_3F_6$, $C_3F_8$, $C_6F_6$, or mixtures thereof; or a gas selected from the group consisting of He, Ne, Ar, Kr, and Xe, or mixtures thereof, in combination with a second compound selected from the group consisting of N,N,N',N'-tetramethyl-1,4-benzenediamine (TMPD); 1,1',3,3'-tetramethyl-Δ2,2'bi(imidazolidine) (TMBI); [tetrakis-(dimethyl)-amino]-ethylene (TMAE); N,N,N',N'-tetramethyl-p-phenylenediamine (TMAB); triethylamine; methylaniline; diethylamine; aniline; Co-ocene; Ch-ocene; Ni-ocene; and Fe-ocene, or mixtures thereof, in combination with a third compound selected from the group consisting of n-$C_4F_{10}$, $C_3F_8$, c-$C_3F_6$ and i-$C_4F_{10}$.

DETAILED DESCRIPTION OF THE PREFERRED EMBODIMENTS

In a fast closing switch of the present type, once the discharge has been triggered by an externally produced electron source, the discharge is self-sustained. That is, it does not require an external source of ionization to maintain the discharge, and will continue until the charge on the capacitor is depleted. This is in contrast to an externally sustained diffuse discharge opening switch which is used in an inductive energy storage circuit to extract pulses of energy from an inductor. This just-mentioned switch concept was the subject of two previous inventions by the present inventors and is described in the aforementioned patent 4,751,428 and in U.S. Pat. No. 4,063,130, the disclosures of which are incorporated herein by reference. Although both the self-sustained closing switch and the externally sustained opening switch rely on diffuse discharges, the operation, use and hence the physio-chemical properties required of the gas mixtures in the two switches are very different.

Figure 1:
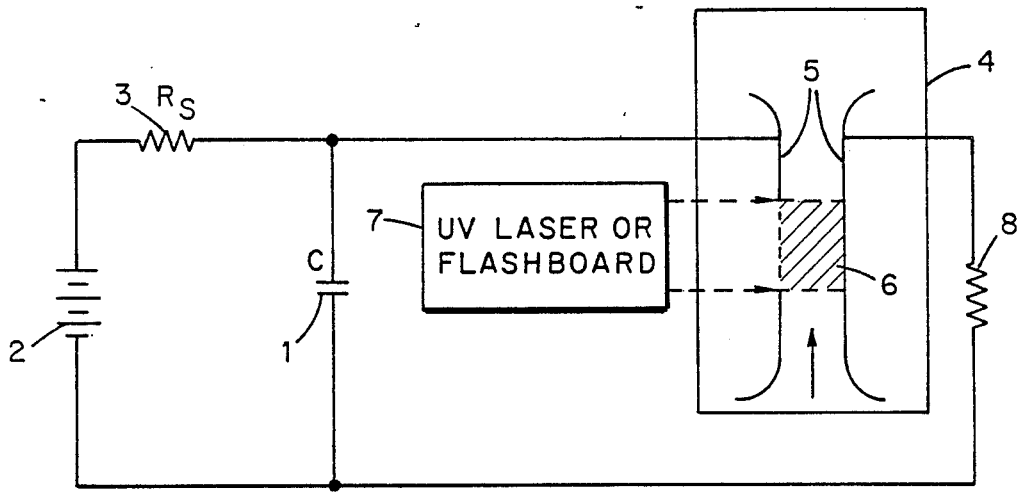
FIG. 1 is a schematic representation of a self-sustained diffuse discharge closing switch in a capacitive energy storage circuit of the type in which the invention can be advantageously employed.
Figure 2:
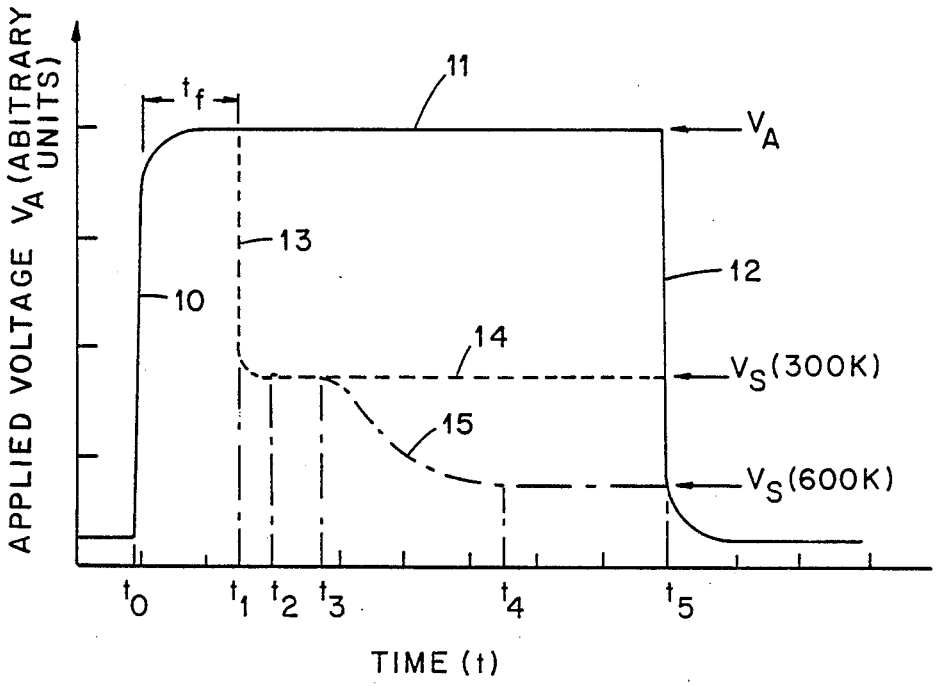
FIG. 2 is a schematic representation of the voltage-time characteristics for the repetitively operated self-sustained switch shown in FIG. 1. The voltage pulse is applied at $t_0$, and the discharge current becomes significant at $t_1$. At $t_3$ the temperature enhanced conductivity process becomes important.
Figure 3:
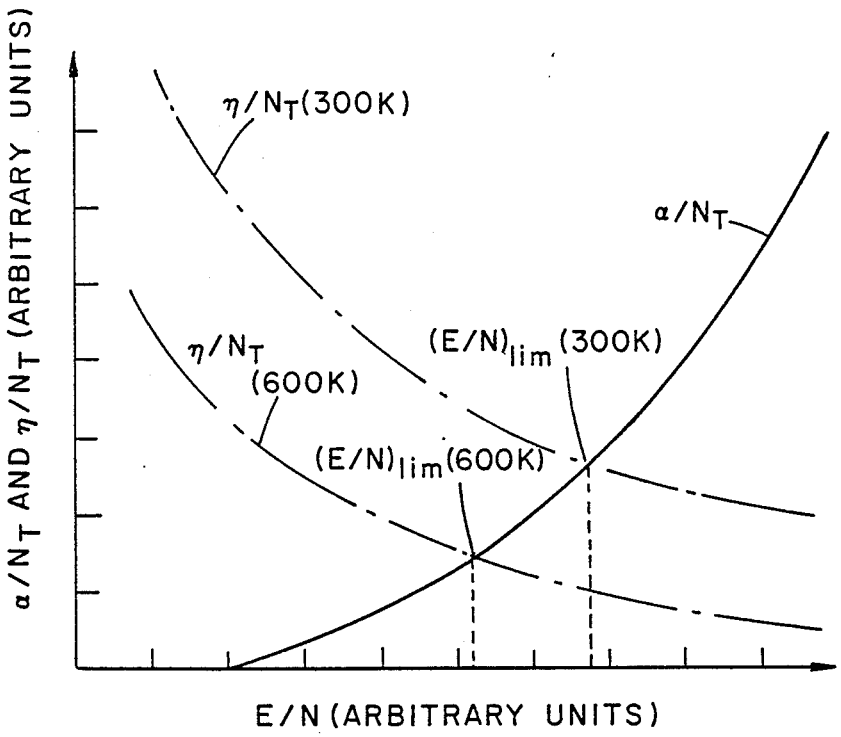
FIG. 3 is a schematic of the desirable electron attachment coefficient $\eta/N$ and ionization coefficient $\alpha/N$ characteristics as a function of E/N at gas temperatures T=300 K. and 600 K. The desirable $(E/N)_{lim}$ values at these temperatures are also indicated.
Figure 4:
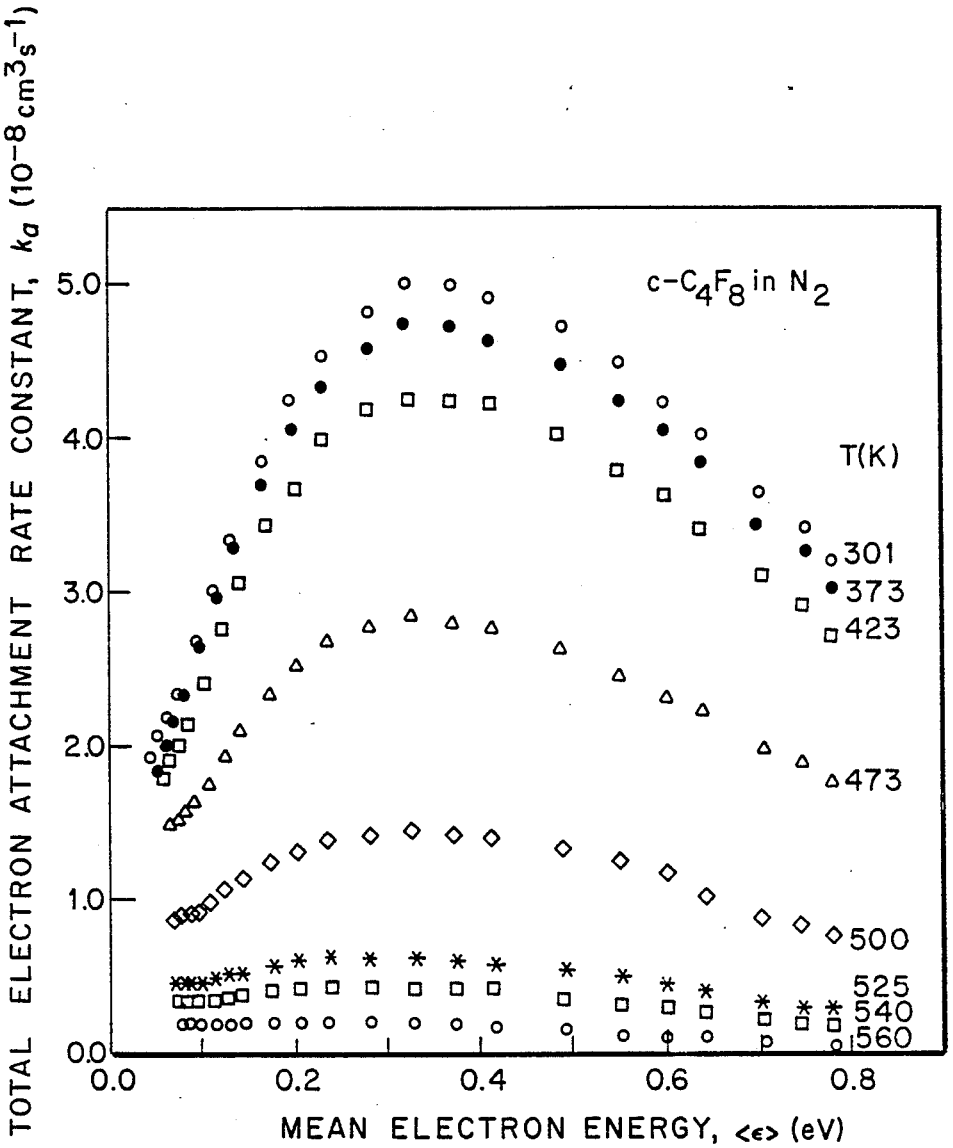
FIG. 4 is a graph of mean electron energy vs total electron attachment rate constant for c-$C_4F_8$ in $N_2$ for various gas temperatures T(K.).
Figure 5:
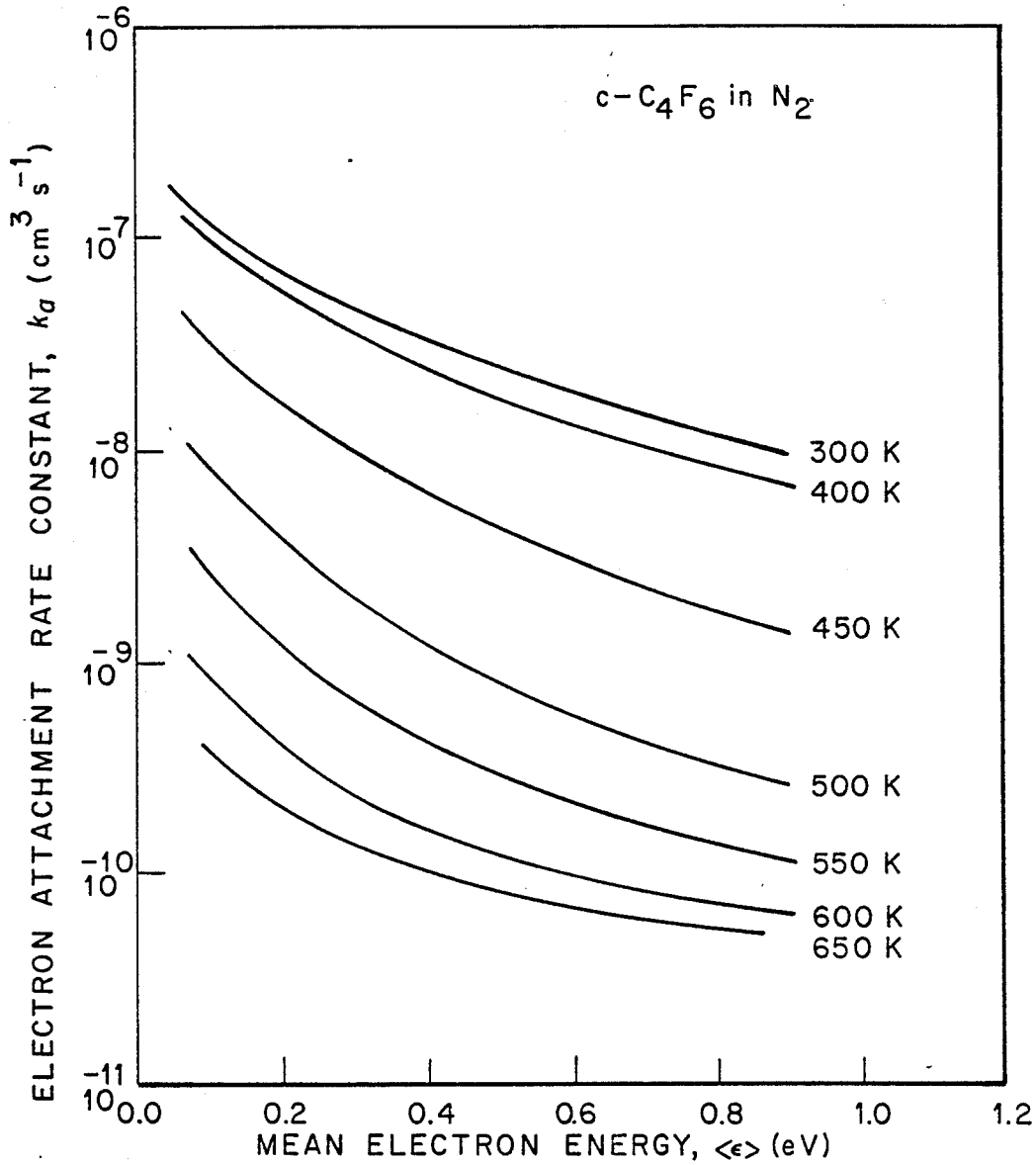
FIG. 5 is a graph as in FIG. 4 but for c-$C_4F_6$ in $N_2$.
Figure 6:
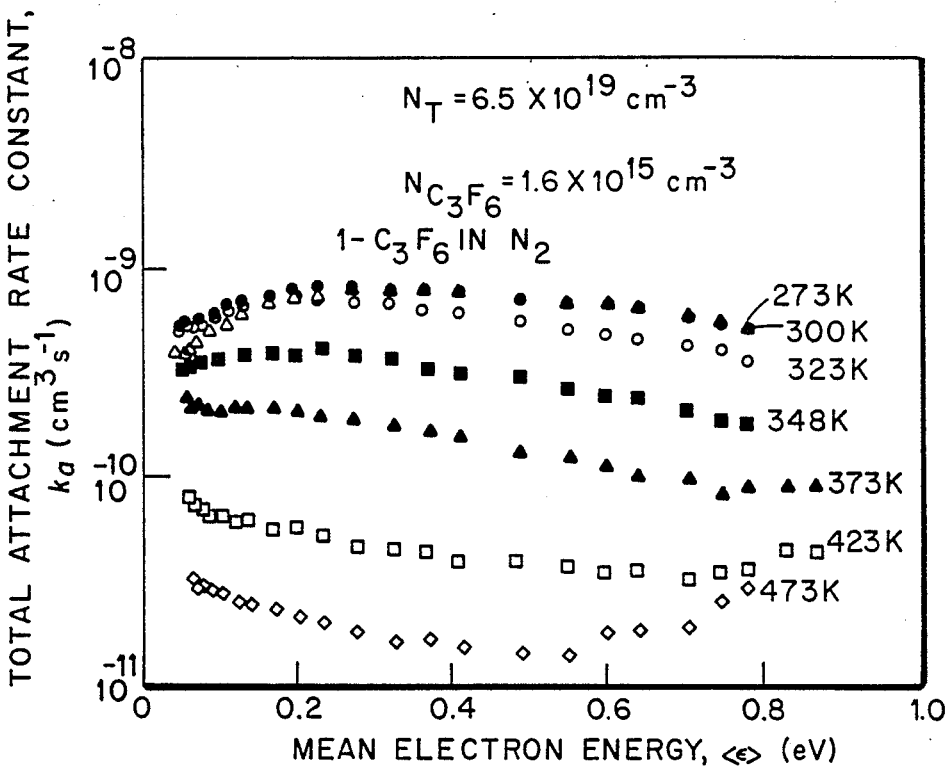
FIG. 6 is a graph as in FIG. 4 but for 1-$C_3F_6$ in $N_2$.
Figure 7:
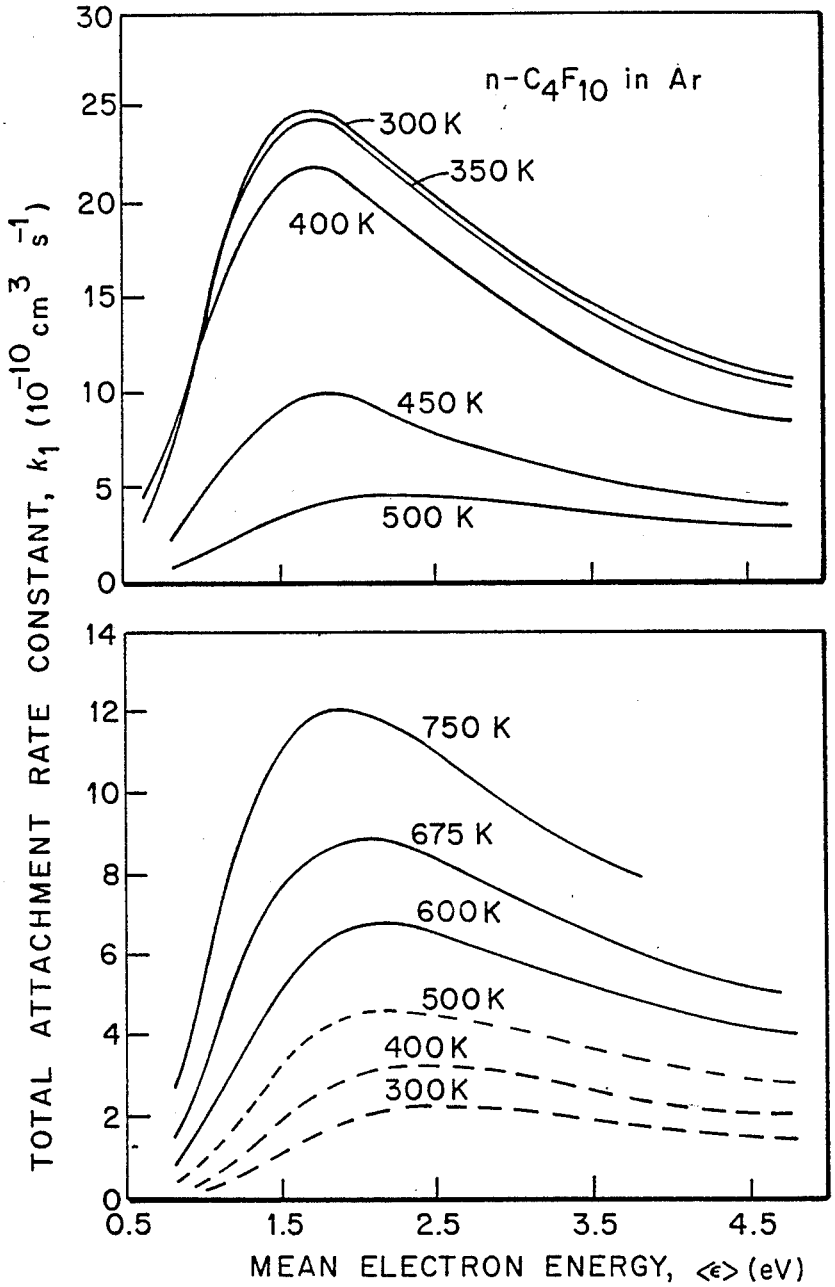
FIG. 7 is a graph as in FIG. 4 but for n-$C_4F_{10}$ in $N_2$.
Figure 8:
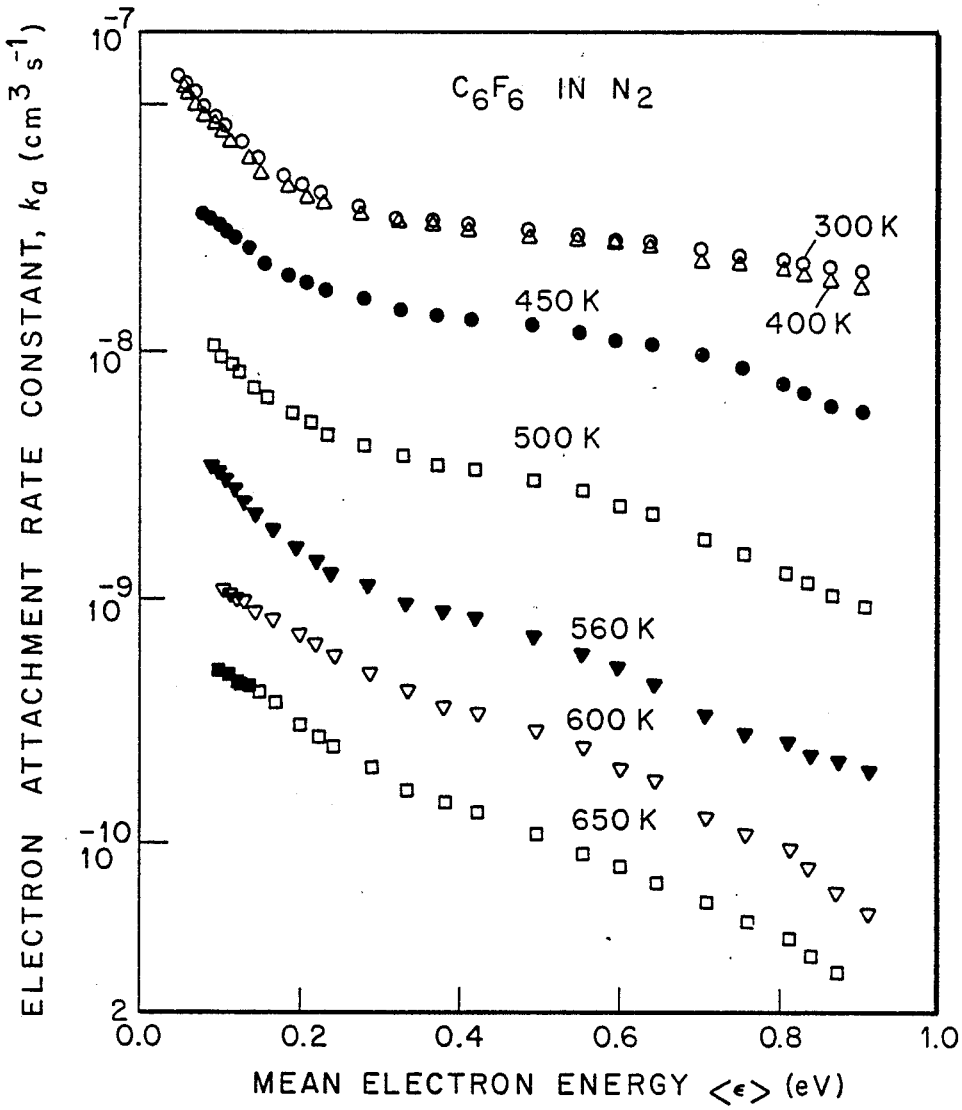
FIG. 8 is a graph as in FIG. 4 but for $C_6F_6$ in $N_2$.

The basic requirements of a gaseous medium for use in a diffuse-discharge closing switch in a capacitive energy storage type pulse generating system can best be understood by a consideration of the operation of the circuit illustrated in FIG. 1. A storage capacitor 1 is charged from a high voltage source 2 through an isolating resistor 3. A switch 4 contains one of the subject mixtures and contains two electrodes 5 separated by a light path 6. The gap 6 is illuminated by a short burst of ultraviolet radiation from a laser of UV flash lamp 7, which produces a uniform photoionization of one or more of the gas components. A fast or slow rising pulse 10, FIG. 2, is then applied across the electrodes at time $t_0$, which has the shape given by curves 10, 11, and 12, and is terminated at time $t_5$. After a given time interval $t_f$ (the formative time lag required for the discharge to develop), a high current, uniform glow discharge is formed in the gap between the electrodes, starting at time $t_1$ and the voltage across the electrodes decreases (curve 13) and levels off at curve 14. At time $t_3$ the gas begins to heat up due to inelastic loss processes in the discharge, and the electron attachment coefficient $\eta/N$ starts to decreases as shown schematically in FIG. 3. The switch voltage $V_s$ [or alternatively the switch electric field strength $(E/N)_{lim}$] similarly decreases as indicated in FIG. 3, and follows curve 15 to a much lower value and levels off at time $t_4$ in FIG. 2. The switch continues to conduct with much improved efficiency until the applied voltage pulse $V_A$ is terminated at time $t_5$, opening the switch.

Several electronegative gases having the desired temperature dependence in the electron attachment process are shown in FIGS. 4–9 where the electron attachment rate $k_a$ (=w($\eta/N$); where $\omega$ is the electron drift velocity and $\eta/N$ is the electron attachment coefficient) is plotted as a function of the mean energy of the electrons $<\epsilon>$ in the discharge at several gas temperatures T. Temperature dependent $(E/N)_{lim}$ curves for several of these gases are shown in FIG. 10. These measurements indicate that as the gas temperature is raised, the operating electric field strength in the switch $(E/N)_{lim}$ decreases.

Figure 9:
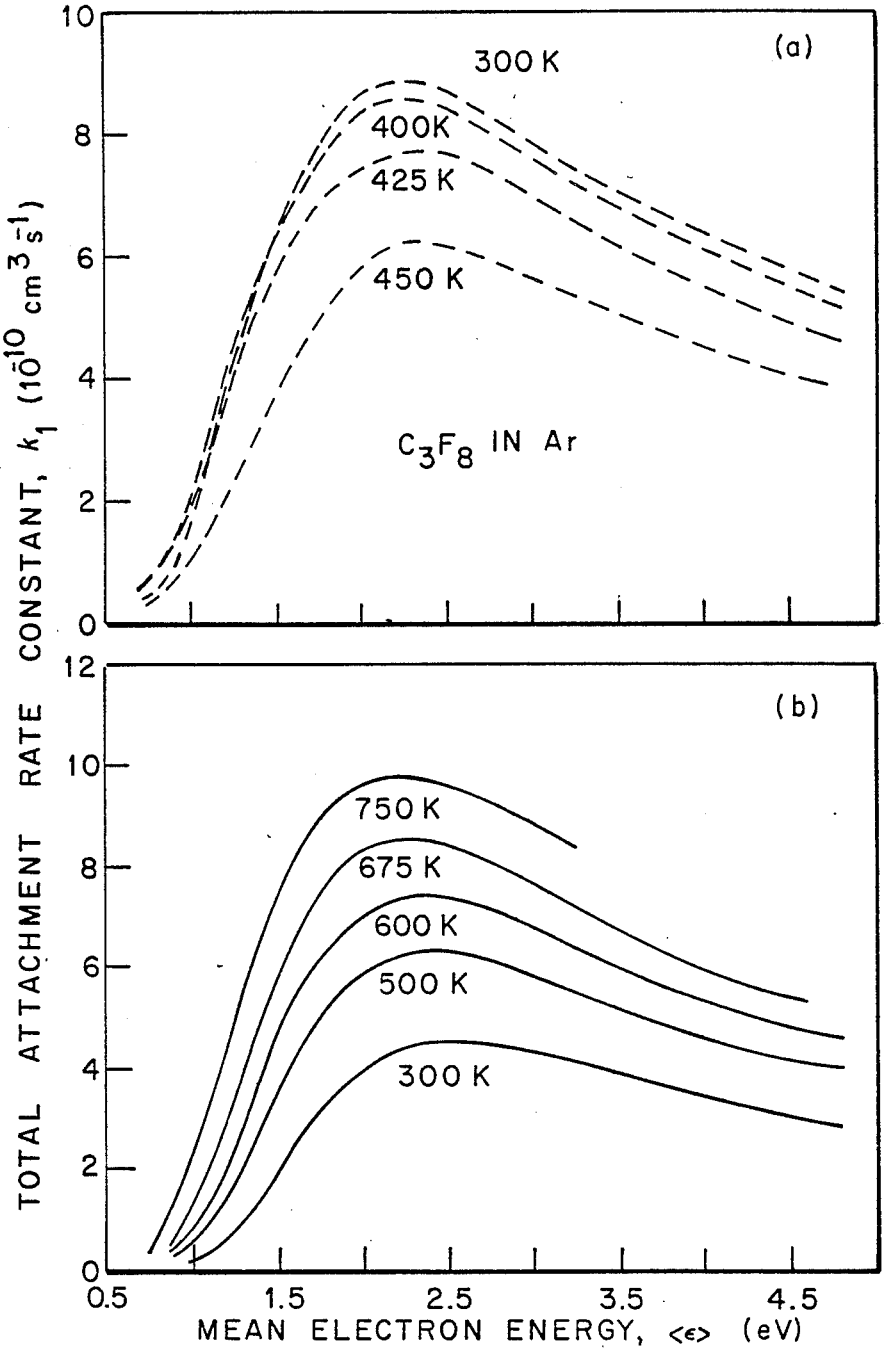
FIG. 9 is a graph as in FIG. 4 but for $C_3F_8$ in $N_2$.
Figure 10:
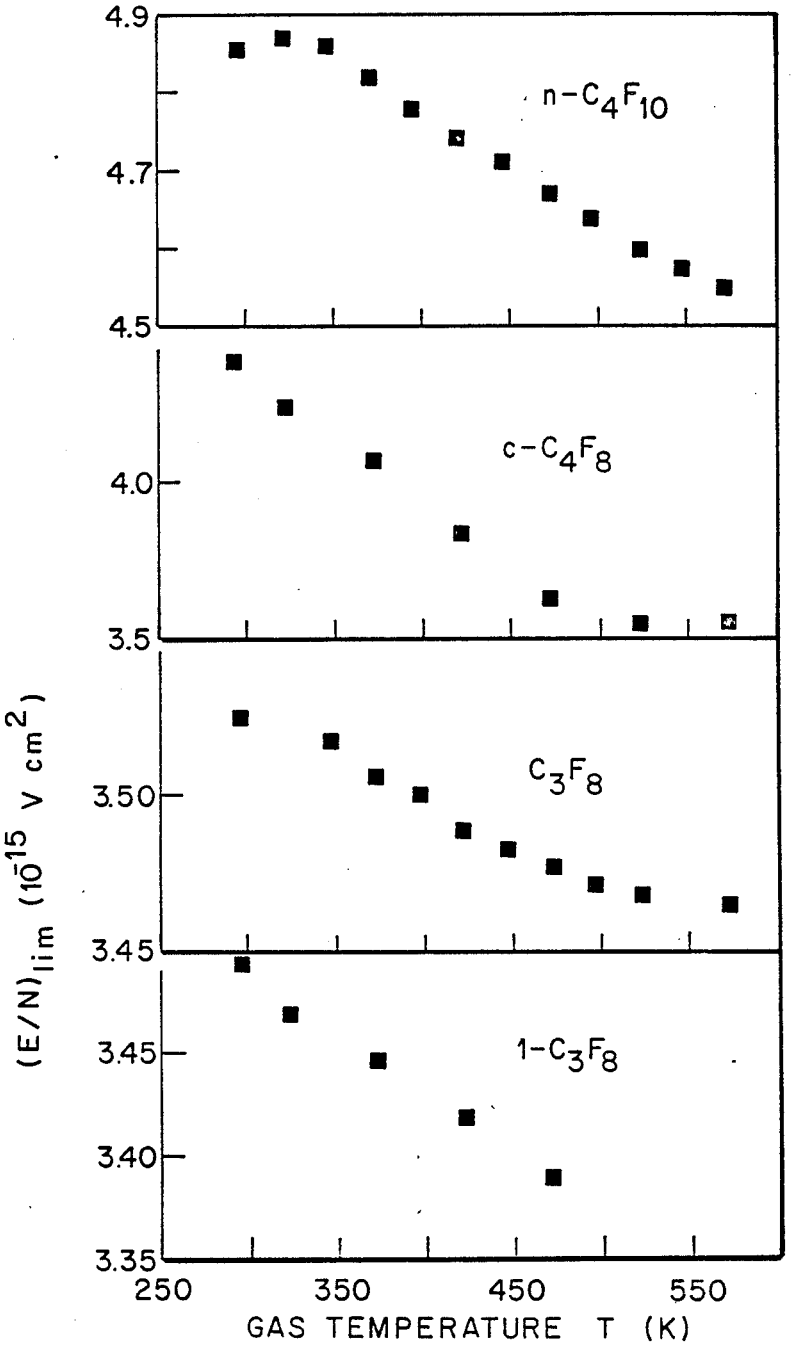
FIG. 10 is a graph of temperature vs $(E/N)_{lim}$ curves for several gases.

The $(E/N)_{lim}$ measurements given in FIG. 9 were performed for pure gases. It is noted that adding 1% to 50% (by volume) of these electronegative gases to a more abundant rare gas buffer gas will reduce the $(E/N)_{lim}$ of the room temperature gas mixtures within the switch, i.e., reduce the voltage drop across the switch at a given gas number density and hence improve the discharge efficiency. Also, the percentage change in the $(E/N)_{lim}$ as a function of gas temperature will be much larger. This is expected to be due to a more favorable overlap of the electron energy distribution function of the electrons in the discharge with the lower energy portion of the electron attachment cross section in the gas mixture than for the pure electron attaching gas.

It is also noted that the $\eta/N$ values in the gas mixture are thus expected to experience a greater percentage decrease with increasing gas temperature near the $(E/N)_{lim}$ value than those of the pure gas, and consequently, $(E/N)_{lim}$ will similarly experience a greater percentage decrease with increasing gas temperature T. This leads to a more efficient switch than is possible with gas temperature independent electron attachment processes.

The binary electron attaching gas mixtures are listed in descending order of preference in Table I below:

TABLE I

| Binary Gas Mixtures | |
|---|---|
| Electron Attaching Gases | Rare Gas Buffer Gases |
| $c\text{-}C_4F_8$ | He |
| $c\text{-}C_4F_6$ | Ne |
| $1\text{-}C_3F_6$ | Kr |
| $n\text{-}C_4F_{10}$ | Xe |
| $C_6F_6$ | Ar |
| $C_3F_8$ | |
| $c\text{-}C_3F_6$ | |

The concentration of the attaching gas in the buffer gas is 1% to 50% by volume. Combinations of all these attaching gases in any of the rare gases are possible.

For ternary gas mixtures, the electron attachment rate constants in $n\text{-}C_4F_{10}$ and $C_3F_8$ indicate that the electron attachment rate constant $k_a[=\omega(\eta/N)]$ at room temperature ($\approx$300 K.) peaks at mean electron energies $\langle\epsilon\rangle=1$ to 3 eV. In particular, the $k_a$ values for $n\text{-}C_4F_{10}$ decrease by almost an order of magnitude over the gas temperature, T, range $350 \leqq T \leqq 500$ K. with the peak in $k_a$ moving from $\langle\epsilon\rangle \approx 1.2$ eV to $\approx 2.2$ eV at 500 K. These specific properties of the electron attachment process in $n\text{-}C_4F_{10}$ (and possibly $C_3F_8$, $c\text{-}C_3F_6$ and $i\text{-}C_4F_{10}$) in which (1) the room temperature $k_a$ values peak at electron energies will in excess of thermal energies (i.e., $<1$ eV), (2) the $k_a$ values considerably decrease in magnitude with increasing gas temperature, and (3) the peak in the $k_a$ measurements moves to higher mean electron energies (i.e., higher E/N values) with increasing gas temperature, can be used to achieve a much greater percentage reduction in $(E/N)_{lim}$ at the higher gas temperatures that can be achieved utilizing the binary gas mixtures.

Figure 11:
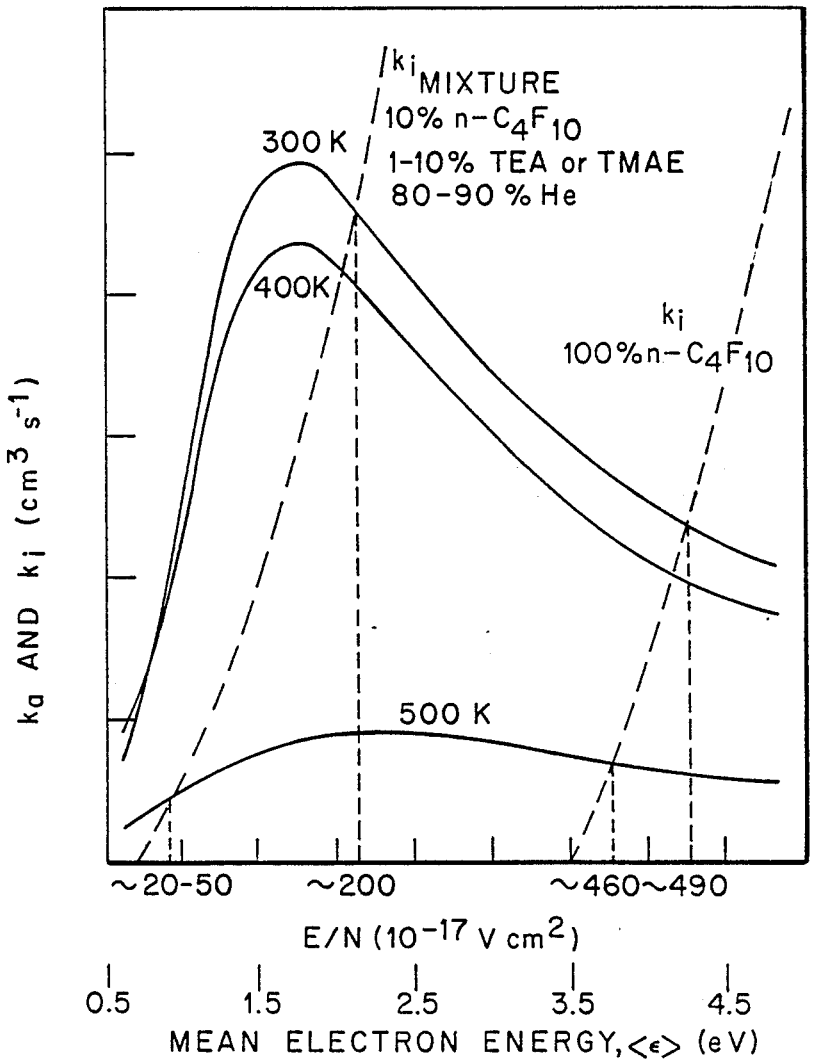
FIG. 11 is a graph as in FIG. 4 also showing advantages of a ternary mixture in terms of (E/N) and $<\epsilon>$ vs $k_i$ and $k_a$.

The principle of the technique can be seen by examining the $k_a$ measurements for $n\text{-}C_4F_{10}$ which are replotted in FIG. 11 along with the expected electron impact ionization rate constant $k_i$ $[=\omega(\alpha/N)]$ for $n\text{-}C_4F_{10}$ plotted both as a function of $\langle\epsilon\rangle$ and also on an approximate E/N scale.

Adding a low ionization threshold gas additive to a mixture of $n\text{-}C_4F_{10}$ in a rare gas buffer gas will cause the $k_i$ curve for the ternary mixture to move to lower $\langle\epsilon\rangle$ (or E/N) values until, for a given concentration of each component the $k_i$ (mixture) curve as a function of $\langle\epsilon\rangle$ (or E/N) is obtained. The $(E/N)_{lim}$ of this mixture (defined when $\alpha/N=\eta/N$ or $k_i=k_a$) at room temperature is about $200\times10^{-17}$ V cm$^2$. When the gas temperature is raised (i.e., during the operation of the gas discharge) the $(E/N)_{lim}$ will move to a much lower value; possibly as low as about $20\times10^{-17}$ V cm$^2$ at about 500 K. as is shown schematically in FIG. 11. The $(E/N)_{lim}$ of this mixture will decrease by up to an order of magnitude; whereas, in the binary mixtures, the $(E/N)_{lim}$ will decrease by at most a factor of 2 to 5. The larger drop in $(E/N)_{lim}$ in the ternary mixture in comparison with that expected in the binary mixtures is due to the $k_i$ curve in the mixture shifting to the low E/N side of the $k_a$ curve at the elevated gas temperatures. This phenomenon does not occur in the binary gas mixtures as the thresholds for ionization in the rare gas buffer gasses and the electron attaching gases are too high ($<12$ eV) for this effect to occur; the effect is due to the presence of the low ionization onset additive in the ternary gas mixture.

The specific characteristics required of each component of the ternary gas mixture are as follows:

1. Electron attaching gas: high energy electron attachment threshold, with $k_a$ ($\langle\epsilon\rangle$) peaking at $\langle\epsilon\rangle$ 1 eV; $k_a$ ($\langle\epsilon\rangle$) strongly dependent on gas temperature; the peak in $k_a$ moves to higher $\langle\epsilon\rangle$ with increasing gas temperature. (these properties are manifested only for a small number of molecules which the inventors have discovered; namely, $n\text{-}C_4F_{10}$, $C_3F_8$, $c\text{-}C_3F_6$ and $i\text{-}C_4F_{10}$.)

2. Low ionization threshold gas additive (threshold $<8$ eV). The concentration of the additive in the electron attaching gas is such that the $(E/N)_{lim}$ of the mixture occurs at E/N values above the peak in the electron attachment coefficient at room temperature, but occurs below the peak in the electron attachment coefficient at gas temperatures $T \approx 500$ K.

3. Rare gas buffer gas to control the mean energy of the discharge (and hence the value of $(E/N)_{lim}$ at room temperature). The suggested gases are given in Table II below.

TERNARY GAS MIXTURES

1. Electron attaching gas with high energy ($\langle\epsilon\rangle<1$ eV) electron attachment peak and strongly temperature dependent electron attachment process.

EXAMPLES—$n\text{-}C_4F_{10}$ (and possibly $C_3F_8$, $c\text{-}C_3F_6$, $i\text{-}C_4F_{10}$)

2. Low ionization threshold gas additive ($\leqq 8$ eV).

| Examples - Amines | | | | |
|---|---|---|---|---|
| | TMAE | TMBI | TMAB | TMPD |
| | $((CH_3)_2N)_4C_2$ | $C_2H_4N_4(C_4H_8)_2$ | $((CH_3)_2N)_4C_4H_2$ | $C_6H_4(N(CH_3)_2)_2$ |
| I.P. (eV) | 5.4 | 5.4 | 5.6 | 6.2 |
| | Triethylamine | Methylaniline | Diethylamine | Aniline |
| | $(C_2H_5)_3N$ | $(C_6H_5NHCH_3)$ | $(C_2H_5)_2NH$ | $(C_6H_5NH_2)$ |
| I.P. (eV) | 7.5 | 7.5 | 8.0 | 8.0 |
| | Ocenes | | | |
| | Co-Ocene | Ch-Ocene | Ni-Ocene | Fe-Ocene |

-continued

| Examples - Amines | | | | |
|---|---|---|---|---|
| | $(C_5H_5)_2Co$ | $(C_5H_5)_2Ch$ | $(C_5H_5)_2Ni$ | $(C_5H_5)_2Fe$ |
| I.P. (eV) | 5.7 | 6.0 | 6.7 | 6.8 |

3. Rare gas buffer gas to determine the mean electron energy He, Ne, Ar, Kr, Xe (preferably He, then Ne).

Approximate concentration of each component.

Electron attaching gas: 1 to 80%

Ionizing gas additive: 0.1 to 20%

Rare gas buffer gas: 0 to 99%

Other gas combinations with similar temperature dependent electron attachment processes are possible; i.e., gases in which the electron attachment process peaks at high mean electron energies (E/N) at room temperature, decreases in magnitude significantly with increasing gas temperature with the peak in the electron attachment rate constant moving to higher mean electron energies (or E/N) at the higher gas temperatures.

It is to be understood that while certain forms of the present invention have been illustrated and described herein, it is not to be limited to the specific forms or arrangement of parts described and shown.

We claim:

1. A capacitive energy storage system comprising:
a diffuse-discharge switch;
a gas mixture in said diffuse-discharge switch comprising He in combination with a compound selected from the group consisting of c-$C_4F_8$, c-$C_4F_6$, n-$C_4F_{10}$, 1-$C_3F_6$, c-$C_3F_6$, $C_3F_8$, $C_6F_6$; and
means for selectively activating said gas mixture to an electrical conductive state.

2. A capacitive energy storage system comprising:
a diffuse-discharge switch;
a gas mixture in said diffuse-discharge switch comprising Ne in combination with a compound selected from the group consisting of c-$C_4F_8$, c-$C_4F_6$, n-$C_4F_{10}$, 1-$C_3F_6$, c-$C_3F_6$, $C_3F_8$, $C_6F_6$; and
means for selectively activating said gas mixture to an electrical conductive state.

3. A capacitive energy storage system comprising:
a diffuse-discharge switch;
a gas mixture in said diffuse-discharge switch comprising Ar in combination with a compound selected from the group consisting of c-$C_4F_8$, c-$C_4F_6$, n-$C_4F_{10}$, 1-$C_3F_6$, c-$C_3F_6$, $C_3F_8$, $C_6F_6$; and
means for selectively activating said gas mixture to an electrical conductive state.

4. A capactive energy storage system comprising:
a diffuse-discharge switch;
a gas mixture in said diffuse-discharge switch comprising Kr in combination with a second compound selected from the group consisting of c-$C_4F_8$, c-$C_4F_6$, n-$C_4F_{10}$, 1-$C_3F_6$, c-$C_3F_6$, $C_3F_8$, $C_6F_6$; and
means for selectively activating said gas mixture to an electrical conductive state.

5. A capacitive energy storage system comprising:
a diffuse-discharge switch;
a gas mixture in said diffuse-discharge switch comprising Xe in combination with a second compound selected from the group consisting of c-$C_4F_8$, c-$C_4F_6$, n-$C_4F_{10}$, 1-$C_3F_6$, c-$C_3F_6$, $C_3F_8$, $C_6F_6$; and
means for selectively activating said gas mixture to an electrical conductive state.

6. A capacitive energy storage system comprising:
a diffuse-discharge switch;
a gas mixture in said diffuse-discharge switch comprising He in combination with a first compound selected from the group consisting of TMPD, TMAE, TMAB, triethylamine, methylaniline, diethylamine, aniline, Co-ocene, Ch-ocene, Ni-ocene and Fe-ocene in combination with a compound selected from a second compound selected from the group consisting of n-$C_4F_{10}$, $C_3F_8$, c-$C_3F_6$ and i-$C_4F_{10}$; and
means for selectively activating said gas mixture to an electrical conductive state.

7. A capacitive energy storage system comprising:
a diffuse-discharge switch;
a gas mixture in said diffusion-discharge switch comprising Ne in combination with a first compound selected from the group consisting of TMPD, TMAE, TMAB, triethylamine, methylaniline, diethylamine, aniline Co-ocene, Ch-ocene, Ni-ocene and Fe-ocene in combination with a compound selected from a second compound selected from the group consisting of n-$C_4F_{10}$, $C_3F_8$, c-$C_3F_6$ and i-$C_4F_{10}$; and
means for selectively activating said gas mixture to an electrical conductive state.

8. A capacitive energy storage system comprising:
a diffuse-discharge switch;
a gas mixture in said diffuse-discharge switch comprising Ar in combination with a first compound selected from the group consisting of TMPD, TMAE, TMAB, triethylamine, methylaniline, diethylamine, aniline, Co-ocene, Ch-ocene, Ni-ocene and Fe-ocene in combination with a compound selected from a second compound selected from the group consisting of n-$C_4F_{10}$, $C_3F_8$, n-$C_3F_6$ and i-$C_4F_{10}$; and
means for selectively activating said gas mixture to an electrical conductive state.

9. A capacitive energy storage system comprising:
a diffuse-discharge switch;
a gas mixture in said diffuse-discharge switch comprising Kr in combination with a first compound selected from the group consisting of TMPD, TMAE, TMAB, triethylamine, methylaniline, diethylamine, aniline, Co-ocene, Ch-ocene, Ni-ocene and Fe-ocene in combination with a compound selected from a second compound selected from the group consisting of n-$C_4F_{10}$, $C_3F_8$, c-$C_3F_6$ and i-$C_4F_{10}$; and
means for selectively activating said gas mixture to an electrical conductive state.

10. A capacitive energy storage system comprising:
a diffuse-discharge switch;
a gas mixture in said diffuse-discharge switch comprising Xe in combination with a first compound selected from the group consisting of TMPD, TMAE, TMAB, triethylamine, methylaniline, diethylamine, aniline, Co-ocene, Ch-ocene, Ni-ocene and Fe-ocene in combination with a compound selected from a second compound selected from the group consisting of n-$C_4F_{10}$, $C_3F_8$, c-$C_3F_6$ and i-$C_4F_{10}$; and
means for selectively activating said gas mixture to an electrical conductive state.

* * * * *